US010043463B2

(12) United States Patent
Hwang et al.

(10) Patent No.: US 10,043,463 B2
(45) Date of Patent: Aug. 7, 2018

(54) DISPLAY APPARATUS AND METHOD OF DRIVING THE SAME

(71) Applicant: SAMSUNG DISPLAY CO., LTD., Yongin-si, Gyeonggi-Do (KR)

(72) Inventors: Hyun Sik Hwang, Hwaseong-si (KR); Yoongu Kim, Seoul (KR); Bongim Park, Hwaseong-si (KR); Byungkook Sim, Hwaseong-si (KR); Ik Hyun Ahn, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 168 days.

(21) Appl. No.: 15/245,462

(22) Filed: Aug. 24, 2016

(65) Prior Publication Data

US 2017/0169776 A1 Jun. 15, 2017

(30) Foreign Application Priority Data

Dec. 11, 2015 (KR) ..... 10-2015-0177132

(51) Int. Cl.
*G09G 3/36* (2006.01)

(52) U.S. Cl.
CPC ..... *G09G 3/3614* (2013.01); *G09G 3/3648* (2013.01); *G09G 2300/0452* (2013.01)

(58) Field of Classification Search
CPC ..... G09G 3/3614; G09G 3/3648; G09G 2300/0452
See application file for complete search history.

(56) References Cited

U.S. PATENT DOCUMENTS

| | | | | |
|---|---|---|---|---|
| 7,109,964 | B2 * | 9/2006 | Pai | G09G 3/3614 345/103 |
| 2002/0089485 | A1 * | 7/2002 | Youn | G09G 3/3614 345/99 |
| 2005/0093806 | A1 * | 5/2005 | Hosotani | G09G 3/2092 345/96 |
| 2015/0062191 | A1 | 3/2015 | Kim et al. | |

* cited by examiner

*Primary Examiner* — Jonathan Boyd
(74) *Attorney, Agent, or Firm* — F. Chau & Associates, LLC

(57) ABSTRACT

A display apparatus includes a display panel comprising a plurality of data lines, a plurality of gate lines crossing the plurality of data lines and a plurality of pixels connected to the plurality of data lines and the plurality of gate lines, each of the plurality of pixels comprising a plurality of color sub-pixels, and a data driver configured to output data voltages of a positive polarity and a negative polarity opposite to the positive polarity with respect to the reference voltage to the plurality of data lines, wherein a polarity stuck period of at least one color sub-pixel of the plurality of color sub-pixels is different from a polarity stuck period of other color sub-pixel of the plurality of color sub-pixels, and the polarity stuck period is a pixel distance in which a same polarity moves per a frame.

20 Claims, 13 Drawing Sheets

FIG. 2A

| POLARITY PERIOD | POLARITY PATTERN | | | | | | | |
|---|---|---|---|---|---|---|---|---|
| | DLm | DLm+1 | DLm+2 | DLm+3 | DLm+4 | DLm+5 | DLm+6 | DLm+7 |
| N_FRAME | + | − | + | − | − | + | − | + |
| (N+1)_FRAME | − | + | − | + | + | − | + | − |
| (N+2)_FRAME | + | + | + | + | − | − | − | − |
| (N+3)_FRAME | − | − | − | − | + | + | + | + |

FIG. 7A

| POLARITY PERIOD | POLARITY PATTERN | | | | | | | |
|---|---|---|---|---|---|---|---|---|
| | DLm | DLm+1 | DLm+2 | DLm+3 | DLm+4 | DLm+5 | DLm+6 | DLm+7 |
| N_FRAME | + | − | + | − | − | + | − | + |
| (N+1)_FRAME | + | + | + | + | − | − | − | − |
| (N+2)_FRAME | − | + | − | + | + | − | + | − |
| (N+3)_FRAME | − | − | − | − | + | + | + | + |

DISPLAY APPARATUS AND METHOD OF DRIVING THE SAME

This application claims priority under 35 U.S.C. § 119 from and the benefit of Korean Patent Application No. 10-2015-0177132 filed on Dec. 11, 2015, which is hereby incorporated by reference for all purposes as if fully set forth herein.

TECHNICAL FIELD

Exemplary embodiments of the inventive concept relate to a display apparatus and a method of driving the display apparatus.

DISCUSSION OF RELATED ART

Generally, a liquid crystal display ('LCD') apparatus includes a first substrate including a pixel electrode, a second substrate including a common electrode and a liquid crystal layer disposed between the first and second substrates. An electric field is generated by voltages applied to the pixel electrode and the common electrode. By adjusting the electric field intensity, transmittance of light passing through the liquid crystal layer may be controlled to display a desired image.

Generally, a display apparatus includes a display panel and a panel driver. The display panel includes a plurality of gate lines, a plurality of data lines and a plurality of sub-pixels connected to the gate lines and the data lines. The panel driver includes a gate driver providing gate signals to the gate lines and a data driver providing data voltages to the data lines.

In an inversion driving mode, data voltages of a positive polarity or a negative polarity opposite to the positive polarity with respect to a reference voltage are applied to the sub-pixels and are reversed by a frame unit.

When the display panel displays a moving image in the inversion driving mode, moving line defects may be observed such as vertical line or horizontal line and on the like according to polarity arrangement of the sub-pixels corresponding to the moving object.

SUMMARY

Exemplary embodiments of the inventive concept provide a display apparatus for eliminating or decreasing moving line defects.

Exemplary embodiments of the inventive concept provide a method of driving the display apparatus.

According to an exemplary embodiment of the inventive concept, there is provided a display apparatus. The display apparatus includes a display panel comprising a plurality of data lines, a plurality of gate lines crossing the plurality of data lines and a plurality of pixels connected to the plurality of data lines and the plurality of gate lines, each of the plurality of pixels comprising a plurality of color sub-pixels and a data driver configured to output data voltages of a positive polarity and a negative polarity opposite to the positive polarity with respect to the reference voltage to the plurality of data lines, wherein a polarity stuck period of at least one color sub-pixel of the plurality of color sub-pixels is different from a polarity stuck period of other color sub-pixel of the plurality of color sub-pixels, the polarity stuck period is a pixel distance in which a same polarity moves per a frame.

In an exemplary embodiment, a polarity stuck period of at least one color sub-pixel of the plurality of color sub-pixels may be irregularly changed by a frame.

In an exemplary embodiment, a polarity stuck period of at least one color sub-pixel of the plurality of color sub-pixels may be irregularly changed by a frame, wherein the irregularly changed period may be periodically repeated.

In an exemplary embodiment, a polarity stuck period of at least one color sub-pixel of the plurality of color sub-pixels may be equal to or less than 1 Pixel Per Frame (PPF).

In an exemplary embodiment, the display panel may include a plurality of pixel rows and a plurality of pixel columns, and color sub-pixels in a pixel column may be alternately connected to two adjacent data lines.

In an exemplary embodiment, the plurality of color sub-pixels may include a red sub-pixel, a green sub-pixel, a blue sub-pixel and a white sub-pixel.

In an exemplary embodiment, the data driver may be configured to output data voltages of polarities corresponding to a first inversion pattern (e.g., +−+−−+−+) to the plurality of data lines in an N-th frame, to output data voltages of polarities opposite to the first inversion pattern (e.g., −+−++−+−) to the plurality of data lines in an (N+1)-th frame, to output data voltages of polarities corresponding to a second inversion pattern (e.g., ++++−−−−) to the plurality of data lines in an (N+2)-th frame, and to output data voltages of polarities opposite to the second inversion pattern (e.g., −−−−++++) to the plurality of data lines in an (N+3)-th frame.

In an exemplary embodiment, the data driver may be configured to output data voltages of polarities corresponding to a first inversion pattern (e.g., +−+−−+−+) to the plurality of data lines in an N-th frame, to output data voltages of polarities corresponding to a second inversion pattern (e.g., ++++−−−−) to the plurality of data lines in an (N+1)-th frame, to output data voltages of polarities opposite to the first inversion pattern (e.g., −+−++−+−) to the plurality of data lines in an (N+2)-th frame, and to output data voltages of polarities opposite to the second inversion pattern (e.g., −−−−++++) to the plurality of data lines in an (N+3)-th frame.

According to an exemplary embodiment of the inventive concept, there is provided a method of driving a display apparatus which comprises a display panel comprising a plurality of data lines, a plurality of gate lines crossing the plurality of data lines and a plurality of pixels connected to the plurality of data lines and the plurality of gate lines, each of the plurality of pixels comprising a plurality of color sub-pixels. The method includes outputting data voltages of a positive polarity and a negative polarity opposite to the positive polarity with respect to the reference voltage to the plurality of data lines, wherein a polarity stuck period of at least one color sub-pixel of the plurality of color sub-pixels is different from a polarity stuck period of another color sub-pixel of the plurality of color sub-pixels, and the polarity stuck period is a pixel distance in which a same polarity moves per a frame.

In an exemplary embodiment, a polarity stuck period of at least one color sub-pixel of the plurality of color sub-pixels may be irregularly changed by a frame.

In an exemplary embodiment, a polarity stuck period of at least one color sub-pixel of the plurality of color sub-pixels may be irregularly changed by a frame, wherein the irregularly changed period may be periodically repeated.

In an exemplary embodiment, a polarity stuck period of at least one color sub-pixel of the plurality of color sub-pixels may be equal to or less than 1 Pixel Per Frame (PPF).

In an exemplary embodiment, the display panel may include a plurality of pixel rows and a plurality of pixel columns, and color sub-pixels in a pixel column may be alternately connected to two adjacent data lines.

In an exemplary embodiment, the plurality of color sub-pixels may include a red sub-pixel, a green sub-pixel, a blue sub-pixel and a white sub-pixel.

In an exemplary embodiment, the data driver may be configured to output data voltages of polarities corresponding to a first inversion pattern (e.g., +−+−−+−+) to the plurality of data lines in an N-th frame, to output data voltages of polarities opposite to the first inversion pattern (e.g., −+−++−+−) to the plurality of data lines in an (N+1)-th frame, to output data voltages of polarities corresponding to a second inversion pattern (e.g., ++++−−−−) to the plurality of data lines in an (N+2)-th frame, and to output data voltages of polarities opposite to the second inversion pattern (e.g., −−−−++++) to the plurality of data lines in an (N+3)-th frame.

In an exemplary embodiment, the data driver may be configured to output data voltages of polarities corresponding to a first inversion pattern (e.g., +−+−−+−+) to the plurality of data lines in an N-th frame, to output data voltages of polarities corresponding to a second inversion pattern (e.g., ++++−−−−) to the plurality of data lines in an (N+1)-th frame, to output data voltages of polarities opposite to the first inversion pattern (e.g., −+−++−+−) to the plurality of data lines in an (N+2)-th frame, and to output data voltages of polarities opposite to the second inversion pattern (e.g., +−+−−+−+) to the plurality of data lines in an (N+3)-th frame.

According to an exemplary embodiment method of driving a display apparatus having a display panel with a plurality of color sub-pixels, the method includes: for each of a plurality of successive frames, outputting to the plurality of color sub-pixels data voltages of a positive polarity and a negative polarity using variable polarity stuck periods being a pixel distance in which a same polarity moves between a pair of successive frames, wherein a polarity stuck period of a first color sub-pixel of the plurality of color sub-pixels between first and second successive frames is different from at least one of a polarity stuck period of a second color sub-pixel between the first and second frames or different from a polarity stuck period of the first color sub-pixel between the second frame and a third successive frame.

In an exemplary embodiment, a different one of a plurality of spatial sub-pixel polarity patterns is output to a plurality of sub-pixels for each of the plurality of successive frames. In an exemplary embodiment, the number of positive and negative polarity data voltages output to each sub-pixel is substantially equal over the plurality of successive frames. In an exemplary embodiment, each of the plurality of sub-pixel polarity patterns is the opposite of another of the plurality of sub-pixel patterns.

Therefore, the polarity stuck period of at least one of the plurality of color sub-pixels is different from the polarity stuck period of another of the plurality of color sub-pixels and thus, the polarity stuck periods of the color sub-pixels are different from the moving speed of the moving image. Accordingly, moving line defects may be substantially minimized or avoided.

BRIEF DESCRIPTION OF THE DRAWINGS

The above and other features and advantages of the inventive concept will become more apparent by describing in detail exemplary embodiments thereof with reference to the accompanying drawings, in which:

FIGS. 2A and 2B are hybrid diagrams illustrating an output polarity pattern and an output polarity period according to an exemplary embodiment;

FIGS. 7A and 7B are hybrid diagrams illustrating an output polarity pattern and an output polarity period according to an exemplary embodiment;

FIGS. 7A and 7B.

DETAILED DESCRIPTION

Hereinafter, the inventive concept will be explained in detail with reference to the accompanying drawings.

Figure 1:
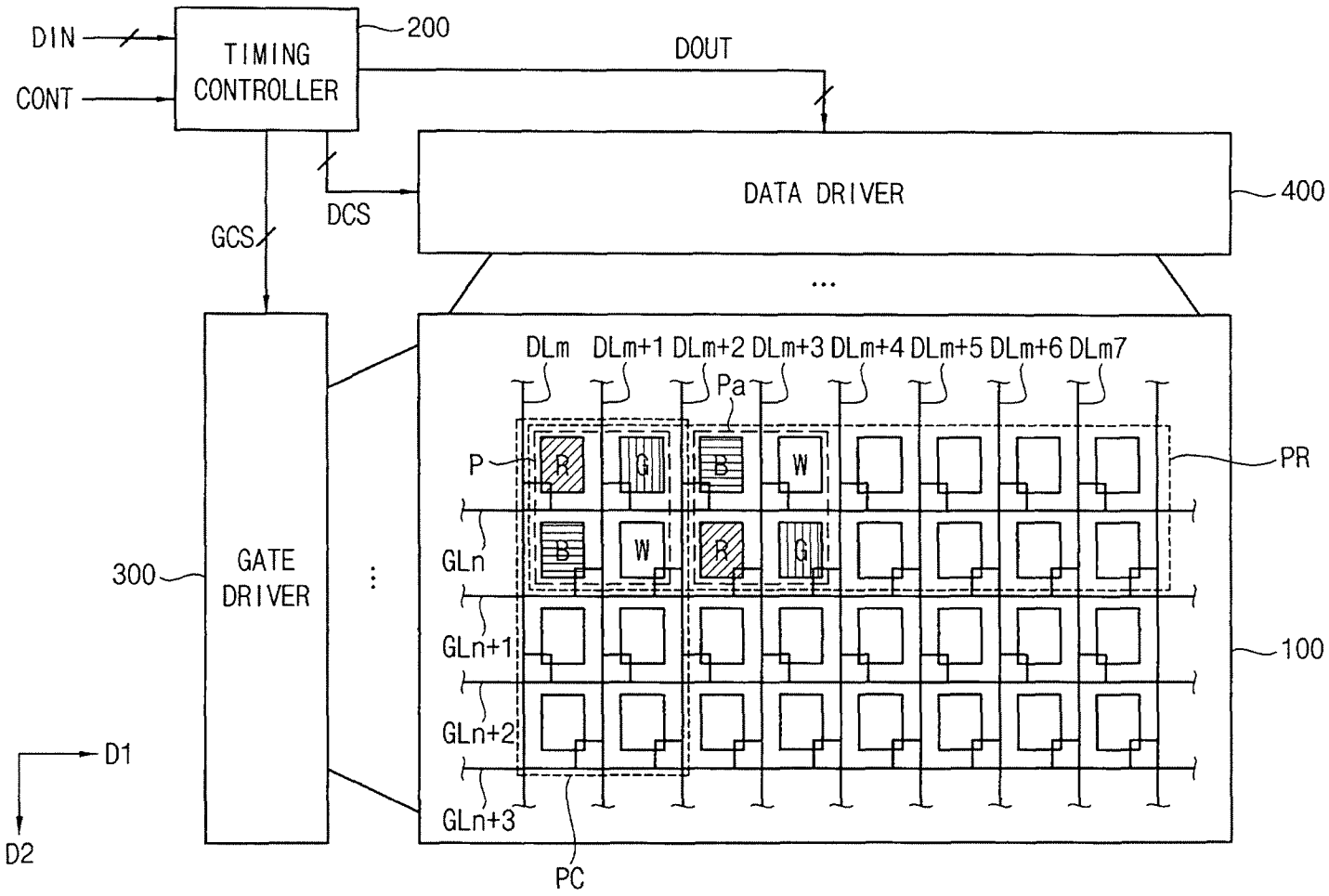
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus may include a display panel 100, a timing controller 200, a gate driver 300 and a data driver 400.

The display panel 100 may include a plurality of gate lines GLn, GLn+1, GLn+2 and GLn+3, a plurality of data lines DLm, DLm+1, DLm+2, DLm+3, DLm+4, DLm+5, DLm+6 and DLm+7 (where 'n' and 'm' are natural numbers), and a plurality of pixels P.

The gate lines GLn, GLn+1, GLn+2 and GLn+3 extend in a first direction D1 and are arranged in a second direction D2 crossing the first direction D1.

The data lines DLm, DLm+1, DLm+2, DLm+3, DLm+4, DLm+5, DLm+6 and DLm+7 extend in the second direction D2 and are arranged in the first direction D1.

The pixels P are arranged in a matrix that includes a plurality of pixel rows PR and a plurality of pixel columns PC. The pixel row PR includes a plurality of pixels arranged in the first direction D1 and the pixel column PC includes a plurality of pixels arranged in the second direction D2. Each of the pixels P includes a plurality of color sub-pixels R, G, B and W.

For example, as shown in FIG. 1, a pixel P may include four sub-pixels, that are a first color sub-pixel, a second color sub-pixel, a third color sub-pixel and a fourth color sub-pixel. Alternatively, the pixel P may include three sub-pixels, that are a first color sub-pixel, a second color sub-pixel and a third color sub-pixel. The four colors may include red, green, blue and white, and three colors may include red, green and blue. Herein, the first color may be referred to as a red R, the second color may be referred to as a green G, the third color may be referred to as a blue B and the fourth color may be referred to as a white W.

The pixel row PR may include a first pixel P and a second pixel Pa. The first pixel P and the second pixel Pa are alternately arranged in the pixel row PR.

The red sub-pixel R is arranged at an upper-left side of the first pixel P, the green sub-pixel G is arranged at an upper-right side of the first pixel P, the blue sub-pixel B is arranged at a lower-left side of the first pixel P and the white sub-pixel W is arranged at a lower-right side of the first pixel P. The blue sub-pixel B is arranged at an upper-left side of the second pixel Pa, the white sub-pixel W is arranged at an upper-right side of the second pixel Pa, the red sub-pixel R is arranged at a lower-left side of the second pixel Pa and the green sub-pixel G is arranged at a lower-right side of the second pixel Pa. However, a pixel column PC corresponding to the first pixel P includes only the first pixel P and a pixel column corresponding to the second pixel Pa includes only the second pixel Pa.

In an alternate embodiment, the pixel row may include only the first pixel P.

In addition, color sub-pixels included in a same sub-pixel column may be alternately connected to two adjacent data lines as an alternateness structure. Alternatively, all color sub-pixels included in a same sub-pixel column may be connected to one of two adjacent data lines as a non-alternateness structure.

Referring to the alternateness structure shown in FIG. 1, color sub-pixels in a same sub-pixel column between an m-th data line DLm and an (m+1)-th data line DLm+1 are alternately connected to the m-th data line DLm and the (m+1)-th data line DLm+1.

The timing controller 200 is configured to receive an input image data signal DIN and an input control signal CONT from an external device. The timing controller 200 is configured to process the input image data signal DIN into an output image data signal DOUT corresponding to the display panel 100 and to output the output image data signal DOUT to the data driver 400. For example, the input image data DIN may include red, green and blue data, and the output image data DOUT may include red, green, blue and white data corresponding to a pixel structure of the display panel 100. The timing controller 200 is configured to generate a gate control signal GCS for controlling the gate driver 300 and a data control signal DCS for controlling the data driver 400 based on the input synchronization signal CONT. The input synchronization signal CONT may include an input vertical synchronization signal, an input horizontal synchronization signal, an input data enable signal, an input clock signal and the like. The gate control signal GCS may include a vertical start signal, a gate clock signal, a gate enable signal and the like. The data control signal DCS may include a horizontal synchronization signal, a pixel signal, a load signal and the like.

According to the exemplary embodiment, the data control signal DCS may include an output polarity control signal which controls polarities of the plurality of data voltages outputting from the data driver 400 to a positive polarity (+) or a negative polarity (−) opposite to the positive polarity (+) with respect to a reference voltage.

The output polarity control signal controls a polarity stuck period. The polarity stuck period may be a pixel distance in which a same polarity moves per a frame. The polarity stuck period may have a unit of PPF (Pixel per Frame).

For example, the output polarity control signal includes an output polarity pattern and an output polarity period. The output polarity control signal controls the data driver 400 so that the polarity stuck periods of the plurality of color sub-pixels are irregularly changed by a frame.

Generally, when the polarity stuck period is equal to a moving speed (PPF) of a moving image, moving line defects are intensified as seen by an observer. Therefore, according to an exemplary embodiment, the polarity stuck periods of the sub-pixels are controlled to be irregularly changed per frame so that the polarity stuck periods of the sub-pixels are not substantially equal to periods resulting from the moving speed in pixels per frame (PPF) of the moving image. Thus, moving line defects may be substantially minimized or avoided.

The gate driver 300 is configured to generate a gate signal based on the gate control signal GCS and to sequentially output the gate signal to the gate lines GLn, GLn+1, GLn+2 and GLn+3 in a scan direction.

The data driver 400 is configured to convert the output image data DOUT to a data voltage using a gamma voltage, to control a polarity of the data voltage into a positive polarity (+) or a negative polarity (−) based on the data control signal DCS and to output the data voltage to the data lines DLm, DLm+1, DLm+2, DLm+3, DLm+4, DLm+5, DLm+6 and DLm+7.

Figure 2B:
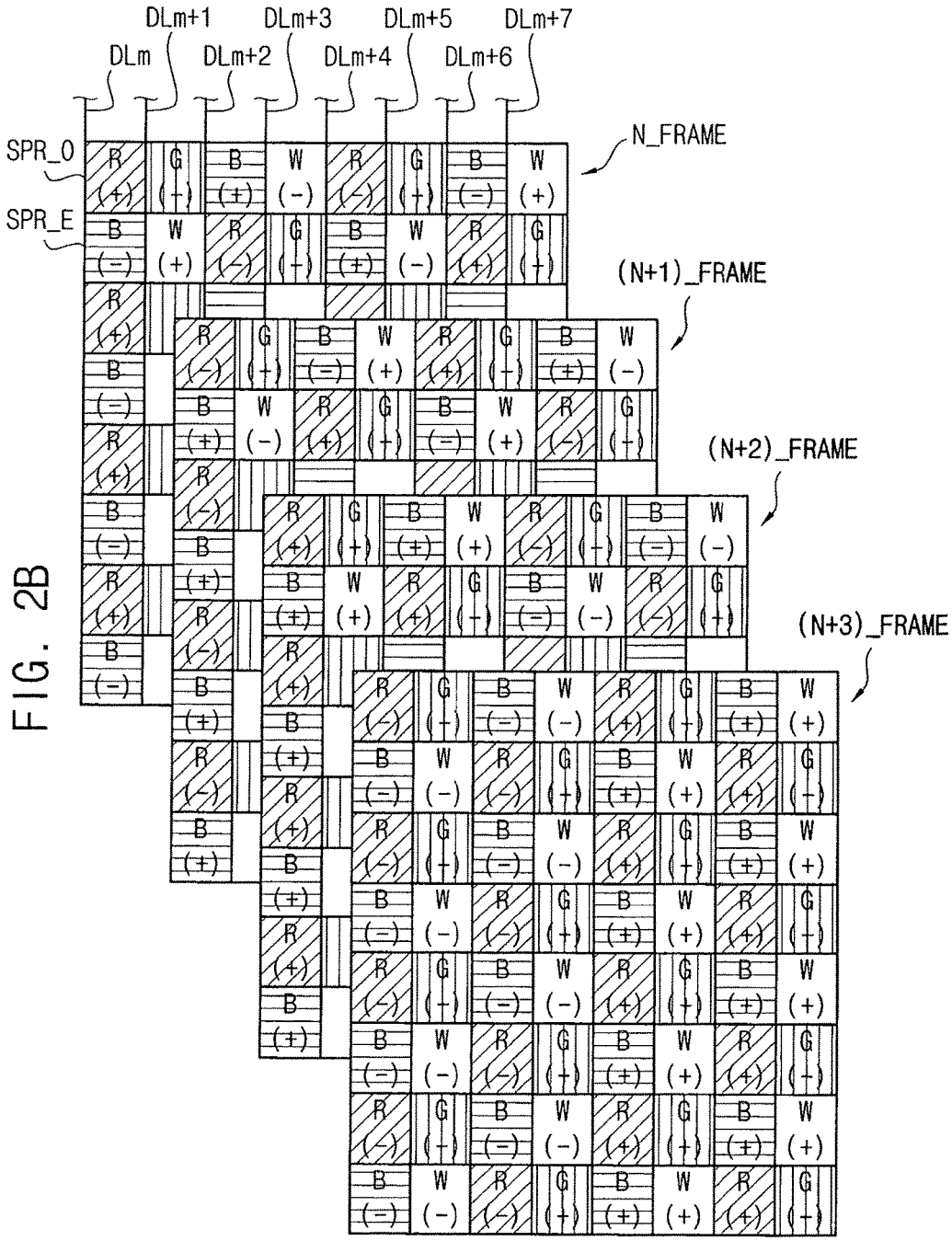

FIGS. 2A and 2B illustrate an output polarity pattern and an output polarity period according to an exemplary embodiment.

FIG. 2A illustrates the output polarity pattern and the output polarity period corresponding to the output polarity control signal. The output polarity pattern and output polarity period may be variously preset, and may be stored in a register of the timing controller. The timing controller is configured to provide the data driver with the output polarity control signal corresponding to the output polarity pattern and the output polarity period.

According to the exemplary embodiment, the output polarity pattern includes a first inversion pattern (+−+−−+−+) and a second inversion pattern (++++−−−−). During two frames the display panel drives with the first inversion pattern (+−+−−+−+) in one frame and its opposite in the next frame, and then, during two frames the display panel drives with the second inversion pattern (++++−−−−) in one frame and its opposite in the next frame. Thus, the output polarity pattern has an output polarity period of four frames.

Thus, during an N-th frame N_FRAME, m-th to (m+7)-th data lines DLm, DLm+1, DLm+2, DLm+3, DLm+4, DLm+5, DLm+6 and DLm+7 output data voltages having a polarity order corresponding to the first inversion pattern (+−+−−+−+), and then during an (N+1)-th frame N+1_FRAME, the m-th to (m+7)-th data lines DLm, DLm+1, DLm+2, DLm+3, DLm+4, DLm+5, DLm+6 and DLm+7 output data voltages having a polarity order (−+−++−+−) opposite to the first inversion pattern (+−+−−+−+).

Referring to the alternateness structure as shown FIG. 2B, during the N-th frame N_FRAME, an odd-numbered color pixel row SPR_O of the display panel repeats polarities of (+−+−−+−+) and an adjacent even-numbered color pixel row SPR_E of the display panel repeats polarities of (−+−−+−++) which are shifted left by one sub-pixel from the polarities (+−+−−+−+) of the odd-numbered color pixel row SPR_O. During the (N+1)-th frame N+1_FRAME, the odd-numbered color pixel row SPR_O of the display panel repeats polarities of (−+−++−+−) and the adjacent even-numbered color pixel row SPR_E of the display panel repeats polarities of (+−++−+−−) which are shifted left by one sub-pixel from the polarities (−+−++−+−) of the odd-numbered color pixel row SPR_O.

During an (N+2)-th frame N+2_FRAME, the m-th to (m+7)-th data lines DLm, DLm+1, DLm+2, DLm+3, DLm+4, DLm+5, DLm+6 and DLm+7 output data voltages having a polarity order corresponding to a second inversion pattern (++++−−−−) and then during an (N+3)-th frame N+3_FRAME, the m-th to (m+7)-th data lines DLm, DLm+1, DLm+2, DLm+3, DLm+4, DLm+5, DLm+6 and DLm+7 output data voltages having a polarity order (−−−−++++) opposite to the second inversion pattern (++++−−−−).

Referring to the alternateness structure in shown FIG. 2B, during the (N+2)-th frame N+2_FRAME, an odd-numbered color pixel row SPR_O of the display panel repeats polarities of (++++−−−−) and an adjacent even-numbered color pixel row SPR_E of the display panel repeats polarities of (+++−−−−+) which are shifted left by one sub-pixel from the polarities (++++−−−−) of the odd-numbered color pixel row SPR_O. During the (N+3)-th frame N+3_FRAME, the odd-numbered color pixel row SPR_O of the display panel repeats polarities of (−−−−++++) and the adjacent even-numbered color pixel row SPR_E of the display panel repeats polarities of (−−−++++−) which are shifted left by one sub-pixel from the polarities (−−−−++++) of the odd-numbered color pixel row SPR_O.

Figure 3:
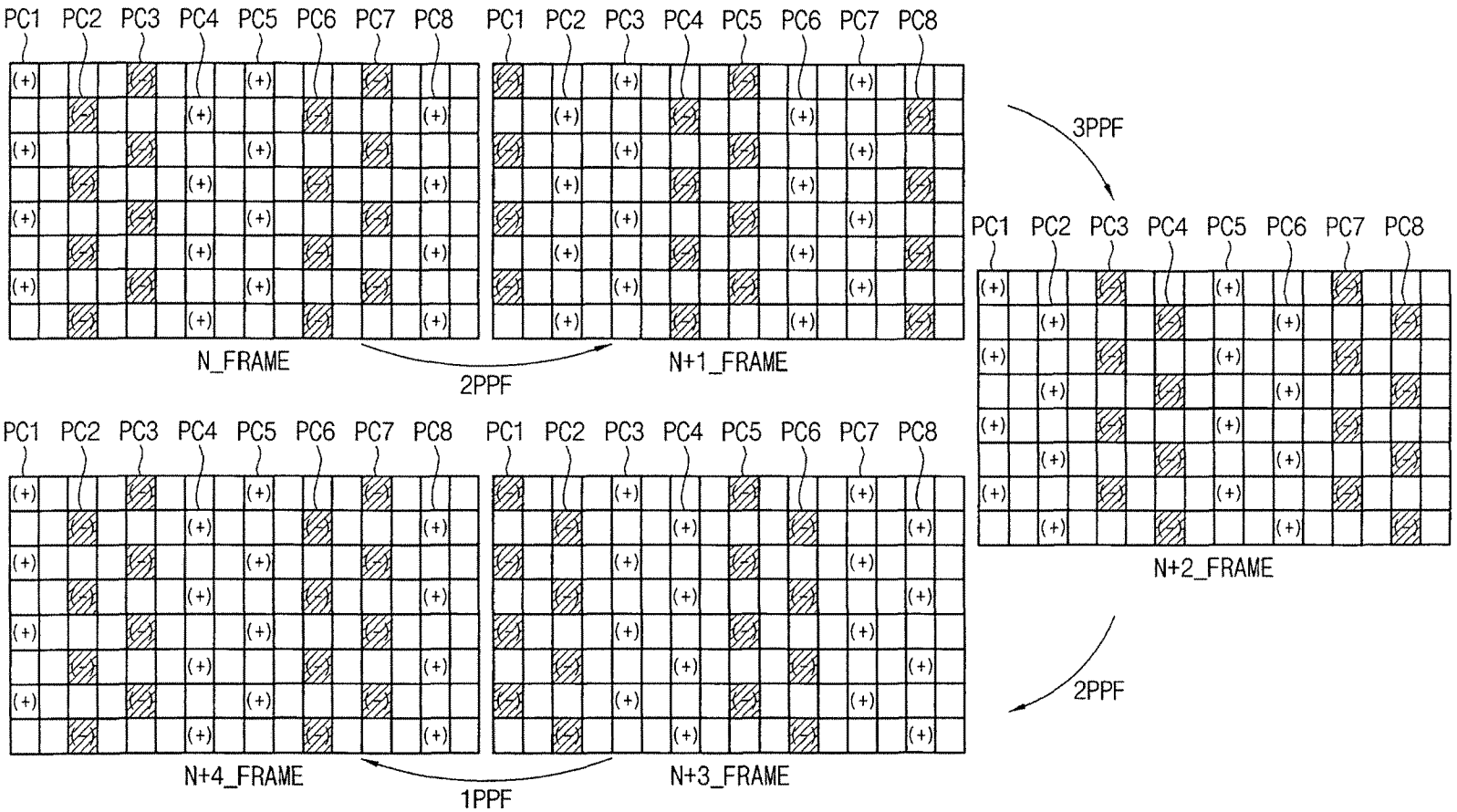
FIG. 3 is a hybrid diagram illustrating a polarity stuck period of a red sub-pixel according to the output polarity pattern and the output polarity period of FIGS. 2A and 2B.

FIG. 3 illustrates a polarity stuck period of a red sub-pixel according to the output polarity pattern and the output polarity period of FIGS. 2A and 2B.

Referring to FIG. 3, during the N-th frame N_FRAME, a red sub-pixel R in a first pixel column PC1 has a positive polarity (+), a red sub-pixel R of a second pixel column PC2 has a negative polarity (−), a red sub-pixel R of a third pixel column PC3 has the negative polarity (−), a red sub-pixel R of a fourth pixel column PC4 has the positive polarity (+), a red sub-pixel R of a fifth pixel column PC5 has the positive polarity (+), a red sub-pixel R of a sixth pixel column PC6 has the negative polarity (−), a red sub-pixel R of a seventh pixel column PC7 has the negative polarity (−) and a red sub-pixel R of an eighth pixel column PC8 has the positive polarity (+).

During the (N+1)-th frame N+1_FRAME, polarities of the third to eighth pixel columns are equal to the polarities of the first to sixth pixel columns in the N-th frame N_FRAME. For example, the red sub-pixel R of the first pixel column PC1 in the N-th frame N_FRAME has the positive polarity (+) being equal to the red sub-pixel R of the third pixel column PC3 in the (N+1)-th frame N+1_FRAME, the red sub-pixel R of the second pixel column PC2 in the N-th frame N_FRAME has the negative polarity (−) being equal to the red sub-pixel R of the fourth pixel column PC4 in the (N+1)-th frame N+1_FRAME, the red sub-pixel R of the third pixel column PC3 in the N-th frame N_FRAME has the negative polarity (−) being equal to the red sub-pixel R of the fifth pixel column PC5 in the (N+1)-th frame N+1_FRAME, the red sub-pixel R of the fourth pixel column PC4 in the N-th frame N_FRAME has the positive polarity (+) being equal to the red sub-pixel R of the sixth pixel column PC6 in the (N+1)-th frame N+1_FRAME, the red sub-pixel R of the fifth pixel column PC5 in the N-th frame N_FRAME has the positive polarity (+) being equal to the red sub-pixel R of the seventh pixel column PC7 in the (N+1)-th frame N+1_FRAME, and the red sub-pixel R of the sixth pixel column PC6 in the N-th frame N_FRAME has the negative polarity (−) being equal to the red sub-pixel R of the eighth pixel column PC8 in the (N+1)-th frame N+1_FRAME. Thus, the polarity stuck period between the red sub-pixels of the N-th and (N+1)-th frames N_FRAME and N+1 FRAME is a 2 PPF.

Likewise, fourth to eighth pixel columns in an (N+2)-th frame N+2_FRAME have polarities being equal to first to fifth pixel columns in the (N+1)-th frame N+1_FRAME. Thus, the polarity stuck period between the red sub-pixels of the (N+1)-th and (N+2)-th frames N+1_FRAME and N+2_FRAME is a 3 PPF.

Third to eighth pixel columns in an (N+3)-th frame N+3_FRAME have polarities being equal to first to sixth pixel columns in the (N+2)-th frame N+2_FRAME. Thus, the polarity stuck period between the red sub-pixels of the (N+2)-th and (N+3)-th framesN+2_FRAME and N+3_FRAME is a 2 PPF.

Second to eighth pixel columns in an (N+4)-th frame N+4_FRAME have polarities being equal to second to eighth pixel columns in the (N+3)-th frame N+3_FRAME. Thus, the polarity stuck period the red sub-pixels of between the (N+3)-th and (N+4)-th frames N+3_FRAME and N+4_FRAME is a 1 PPF.

As described above, the polarity stuck period of the red sub-pixel R has an irregular period that changes every frame such as 2 PPF/3 PPF/2 PPF/1 PPF, and such irregular period may be repeated.

Figure 4:
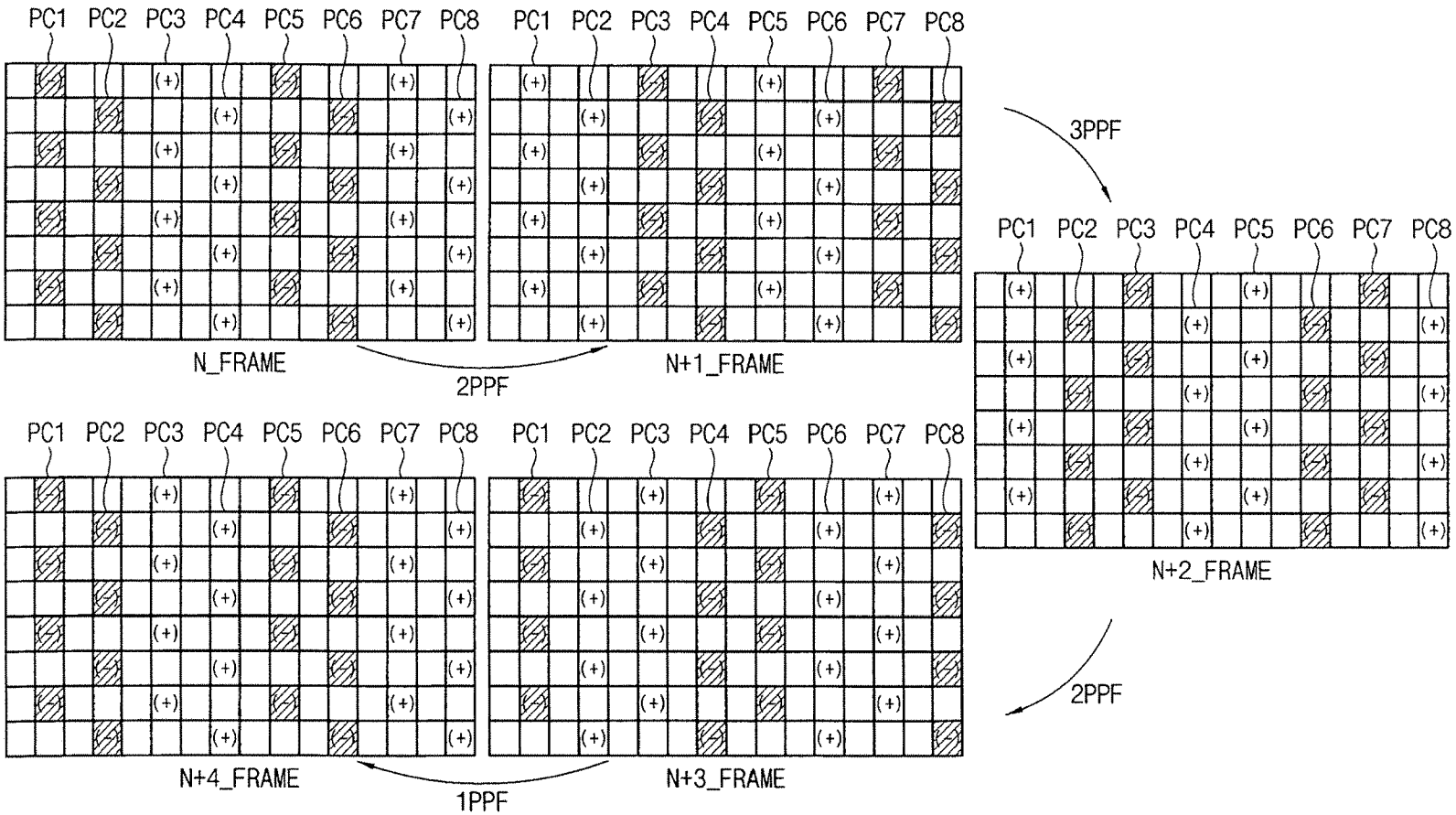
FIG. 4 is a hybrid diagram illustrating a polarity stuck period of a green sub-pixel according to the output polarity pattern and the output polarity period of FIGS. 2A and 2B.

FIG. 4 illustrates a polarity stuck period of a green sub-pixel according to the output polarity pattern and the output polarity period of FIGS. 2A and 2B.

Referring to FIG. 4, during the N-th frame N_FRAME, a green sub-pixel G in a first pixel column PC1 has a negative polarity (−), a green sub-pixel G of a second pixel column PC2 has the negative polarity (−), a green sub-pixel G of a third pixel column PC3 has a positive polarity (+), a green sub-pixel G of a fourth pixel column PC4 has the positive polarity (+), a green sub-pixel G of a fifth pixel column PC5 has the negative polarity (−), a green sub-pixel G of a sixth pixel column PC6 has the negative polarity (−), a green sub-pixel G of a seventh pixel column PC7 has the positive polarity (+) and a green sub-pixel G of an eighth pixel column PC8 has the positive polarity (+).

Then, during the (N+1)-th frame N+1_FRAME, polarities of the third to eighth pixel columns are equal to the polarities of the first to sixth pixel columns in the N-th frame N_FRAME. For example, the green sub-pixel G of the first pixel column PC1 in the N-th frame N_FRAME has the negative polarity (−) being equal to the green sub-pixel G of the third pixel column PC3 in the (N+1)-th frame N+1_FRAME, the green sub-pixel G of the second pixel column PC2 in the N-th frame N_FRAME has the negative polarity (−) being equal to the green sub-pixel G of the fourth pixel column PC4 in the (N+1)-th frame N+1_FRAME, the green sub-pixel G of the third pixel column PC3 in the N-th frame N_FRAME has the positive polarity (+) being equal to the green sub-pixel G of the fifth pixel column PC5 in the (N+1)-th frame N+1_FRAME, the green sub-pixel G of the fourth pixel column PC4 in the N-th frame N_FRAME has the positive polarity (+) being equal to the green sub-pixel G of the sixth pixel column PC6 in the (N+1)-th frame N+1_FRAME, the green sub-pixel G of the fifth pixel column PC5 in the N-th frame N_FRAME has the negative (−) being equal to the green sub-pixel G of the seventh pixel column PC7 in the (N+1)-th frame N+1_FRAME, and the green sub-pixel G of the sixth pixel column PC6 in the N-th frame N_FRAME has the negative polarity (−) being equal to the green sub-pixel G of the eighth pixel column PC8 in the (N+1)-th frame N+1_FRAME. Thus, the polarity stuck period between the green sub-pixels of the N-th and (N+1)-th frames N_FRAME and N+1_FRAME is a 2 PPF.

As described above, fourth to eighth pixel columns in an (N+2)-th frame N+2_FRAME have polarities being equal to first to fifth pixel columns in the (N+1)-th frame N+1_FRAME. Thus, the polarity stuck period between the green sub-pixels of the (N+1)-th and (N+2)-th frames N+1_FRAME and N+2_FRAME is a 3 PPF.

Third to eighth pixel columns in an (N+3)-th frame N+3_FRAME have polarities being equal to first to sixth pixel columns in the (N+2)-th frame N+2_FRAME. Thus, the polarity stuck period between the green sub-pixels of the (N+2)-th and (N+3)-th framesN+2_FRAME and N+3_FRAME is a 2 PPF.

Second to eighth pixel columns in an (N+4)-th frame N+4_FRAME have polarities being equal to second to eighth pixel columns in the (N+3)-th frame N+3_FRAME. Thus, the polarity stuck period the green sub-pixels of between the (N+3)-th and (N+4)-th frames N+3_FRAME and N+4_FRAME is a 1 PPF.

As described above, the polarity stuck period of the green sub-pixel G has an irregular period changed each frame, such as 2 PPF/3 PPF/2 PPF/1 PPF, and such irregular period may be repeated.

Figure 5:
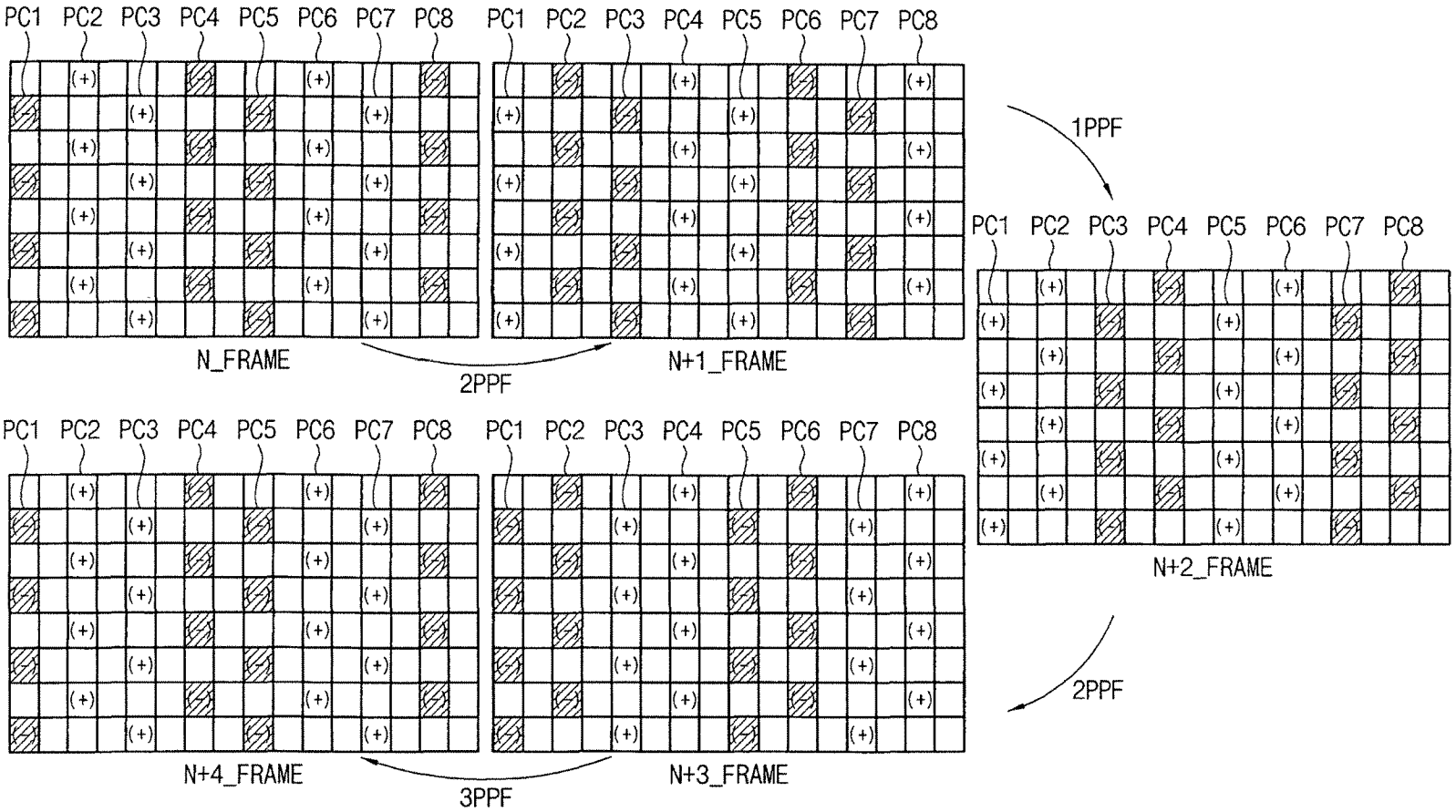
FIG. 5 is a hybrid diagram illustrating a polarity stuck period of a blue sub-pixel according to the output polarity pattern and the output polarity period of FIGS. 2A and 2B.

FIG. 5 illustrates a polarity stuck period of a blue sub-pixel according to the output polarity pattern and the output polarity period of FIGS. 2A and 2B.

Referring to FIG. 5, during the N-th frame N_FRAME, a blue sub-pixel B in a first pixel column PC1 has a negative polarity (−), a blue sub-pixel B of a second pixel column PC2 has a positive polarity (+), a blue sub-pixel B of a third pixel column PC3 has the positive polarity (+), a blue sub-pixel B of a fourth pixel column PC4 has the negative polarity (−), a blue sub-pixel B of a fifth pixel column PC5 has the negative polarity (−), a blue sub-pixel B of a sixth pixel column PC6 has the positive polarity (+), a blue sub-pixel B of a seventh pixel column PC7 has the positive polarity (+) and a blue sub-pixel B of an eighth pixel column PC8 has the negative polarity (−).

Then, during the (N+1)-th frame N+1_FRAME, polarities of the third to eighth pixel columns are equal to the polarities of the first to sixth pixel columns in the N-th frame N_FRAME. For example, the blue sub-pixel B of the first pixel column PC1 in the N-th frame N_FRAME has the negative polarity (−) being equal to the blue sub-pixel B of the third pixel column PC3 in the (N+1)-th frame N+1_FRAME, the blue sub-pixel B of the second pixel column PC2 in the N-th frame N_FRAME has the positive polarity (+) being equal to the blue sub-pixel B of the fourth pixel column PC4 in the (N+1)-th frame N+1_FRAME, the blue sub-pixel B of the third pixel column PC3 in the N-th frame N_FRAME has the positive polarity (+) being equal to the blue sub-pixel B of the fifth pixel column PC5 in the (N+1)-th frame N+1_FRAME, the blue sub-pixel B of the fourth pixel column PC4 in the N-th frame N_FRAME has the negative polarity (−) being equal to the blue sub-pixel B of the sixth pixel column PC6 in the (N+1)-th frame N+1_FRAME, the blue sub-pixel B of the fifth pixel column PC5 in the N-th frame N_FRAME has the negative polarity (−) being equal to the blue sub-pixel B of the seventh pixel column PC7 in the (N+1)-th frame N+1_FRAME, and the blue sub-pixel B of the sixth pixel column PC6 in the N-th frame N_FRAME has the positive polarity (+) being equal to the blue sub-pixel B of the eighth pixel column PC8 in the (N+1)-th frame N+1_FRAME. Thus, the polarity stuck period between the blue sub-pixels of the N-th and (N+1)-th frames N_FRAME and N+1_FRAME is a 2 PPF.

As described above, second to eighth pixel columns in an (N+2)-th frame N+2_FRAME have polarities being equal to first to seventh pixel columns in the (N+1)-th frame N+1_FRAME. Thus, the polarity stuck period between the blue sub-pixels of the (N+1)-th and (N+2)-th frames N+1_FRAME and N+2_FRAME is a 1 PPF.

Third to eighth pixel columns in an (N+3)-th frame N+3_FRAME have polarities being equal to first to sixth pixel columns in the (N+2)-th frame N+2_FRAME. Thus, the polarity stuck period between the blue sub-pixels of the (N+2)-th and (N+3)-th framesN+2_FRAME and N+3_FRAME is a 2 PPF.

Fourth to eighth pixel columns in an (N+4)-th frame N+4_FRAME have polarities being equal to first to fifth pixel columns in the (N+3)-th frame N+3_FRAME. Thus, the polarity stuck period the blue sub-pixels of between the (N+3)-th and (N+4)-th frames N+3_FRAME and N+4_FRAME is a 1 PPF.

As described above, the polarity stuck period of the red sub-pixel R has an irregular period changing every frame such as 2 PPF/1 PPF/2 PPF/3 PPF and repeated.

Figure 6:
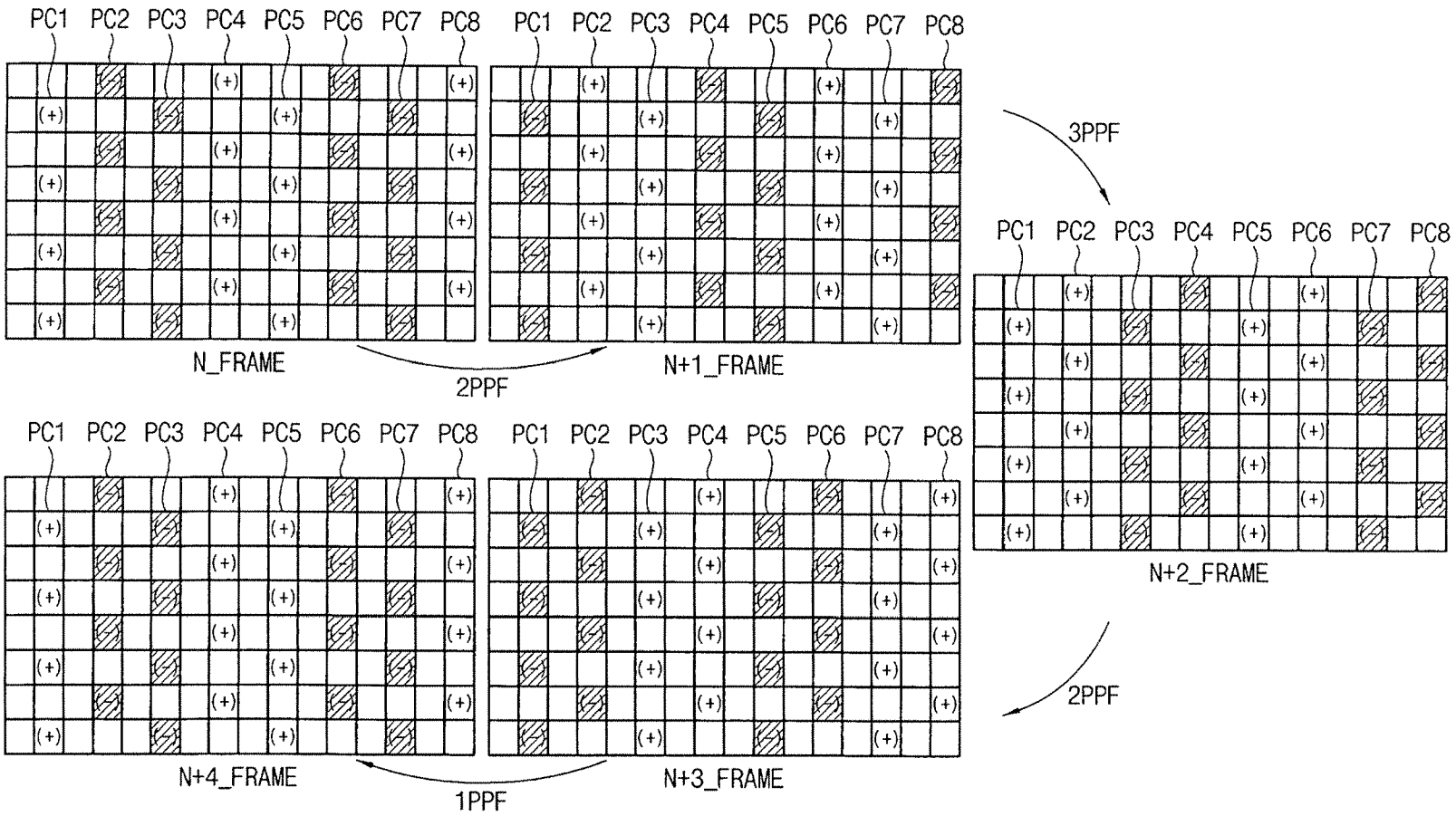
FIG. 6 is a hybrid diagram illustrating a polarity stuck period of a white sub-pixel according to the output polarity pattern and the output polarity period of FIGS. 2A and 2B.

FIG. 6 illustrates a polarity stuck period of a white sub-pixel according to the output polarity pattern and the output polarity period of FIGS. 2A and 2B.

Referring to FIG. 6, during the N-th frame N_FRAME, a white sub-pixel W in a first pixel column PC1 has a positive polarity (+), a white sub-pixel W of a second pixel column PC2 has a negative polarity (−), a white sub-pixel W of a third pixel column PC3 has the negative polarity (−), a white sub-pixel W of a fourth pixel column PC4 has the positive polarity (+), a white sub-pixel W of a fifth pixel column PC5 has the positive polarity (+), a white sub-pixel W of a sixth pixel column PC6 has the negative polarity (−), a white sub-pixel W of a seventh pixel column PC7 has the negative polarity (−) and a white sub-pixel W of an eighth pixel column PC8 has the positive polarity (+).

Then, during the (N+1)-th frame N+1_FRAME, polarities of the third to eighth pixel columns are equal to the polarities of the first to sixth pixel columns in the N-th frame N_FRAME. For example, the white sub-pixel W of the first pixel column PC1 in the N-th frame N_FRAME has the positive polarity (+) being equal to the white sub-pixel W of the third pixel column PC3 in the (N+1)-th frame N+1_FRAME, the white sub-pixel W of the second pixel column PC2 in the N-th frame N_FRAME has the negative polarity (−) being equal to the white sub-pixel W of the fourth pixel column PC4 in the (N+1)-th frame N+1_FRAME, the white sub-pixel W of the third pixel column PC3 in the N-th frame N_FRAME has the negative polarity (−) being equal to the white sub-pixel W of the fifth pixel column PC5 in the (N+1)-th frame N+1_FRAME, the white sub-pixel W of the fourth pixel column PC4 in the N-th frame N_FRAME has the positive polarity (+) being equal to the white sub-pixel W of the sixth pixel column PC6 in the (N+1)-th frame N+1_FRAME, the white sub-pixel W of the fifth pixel column PC5 in the N-th frame N_FRAME has the positive polarity (+) being equal to the white sub-pixel W of the seventh pixel column PC7 in the (N+1)-th frame N+1_FRAME, and the white sub-pixel W of the sixth pixel column PC6 in the N-th frame N_FRAME has the negative polarity (−) being equal to the white sub-pixel W of the eighth pixel column PC8 in the (N+1)-th frame N+1_FRAME. Thus, the polarity stuck period between the white sub-pixels of the N-th and (N+1)-th frames N_FRAME and N+1_FRAME is a 2 PPF.

As described above, fourth to eighth pixel columns in an (N+2)-th frame N+2_FRAME have polarities being equal to first to fifth pixel columns in the (N+1)-th frame N+1_FRAME. Thus, the polarity stuck period between the white sub-pixels of the (N+1)-th and (N+2)-th frames N+1_FRAME and N+2_FRAME is a 3 PPF.

Third to eighth pixel columns in an (N+3)-th frame N+3_FRAME have polarities being equal to first to sixth pixel columns in the (N+2)-th frame N+2_FRAME. Thus, the polarity stuck period between the white sub-pixels of the (N+2)-th and (N+3)-th framesN+2_FRAME and N+3_FRAME is a 2 PPF.

Second to eighth pixel columns in an (N+4)-th frame N+4_FRAME have polarities being equal to second to eighth pixel columns in the (N+3)-th frame N+3_FRAME. Thus, the polarity stuck period the white sub-pixels of between the (N+3)-th and (N+4)-th frames N+3_FRAME and N+4_FRAME is a 1 PPF.

As described above, the polarity stuck period of the red sub-pixel R has an irregular period changing every frame such as 2 PPF/3 PPF/2 PPF/1 PPF and repeated.

According to the exemplary embodiment described above, the data driver controls the polarity of the output voltage based on the output polarity control signal received from the timing controller. Thus, the polarity stuck period in a frame is irregularly changed to differ from the moving speed of the moving image. For example, a polarity stuck period of a first color sub-pixel of the plurality of color sub-pixels between first and second successive frames is different from a polarity stuck period of the first color sub-pixel between the second frame and a third successive frame.

Therefore, the moving line defects may be substantially minimized or avoided.

Figure 7B:
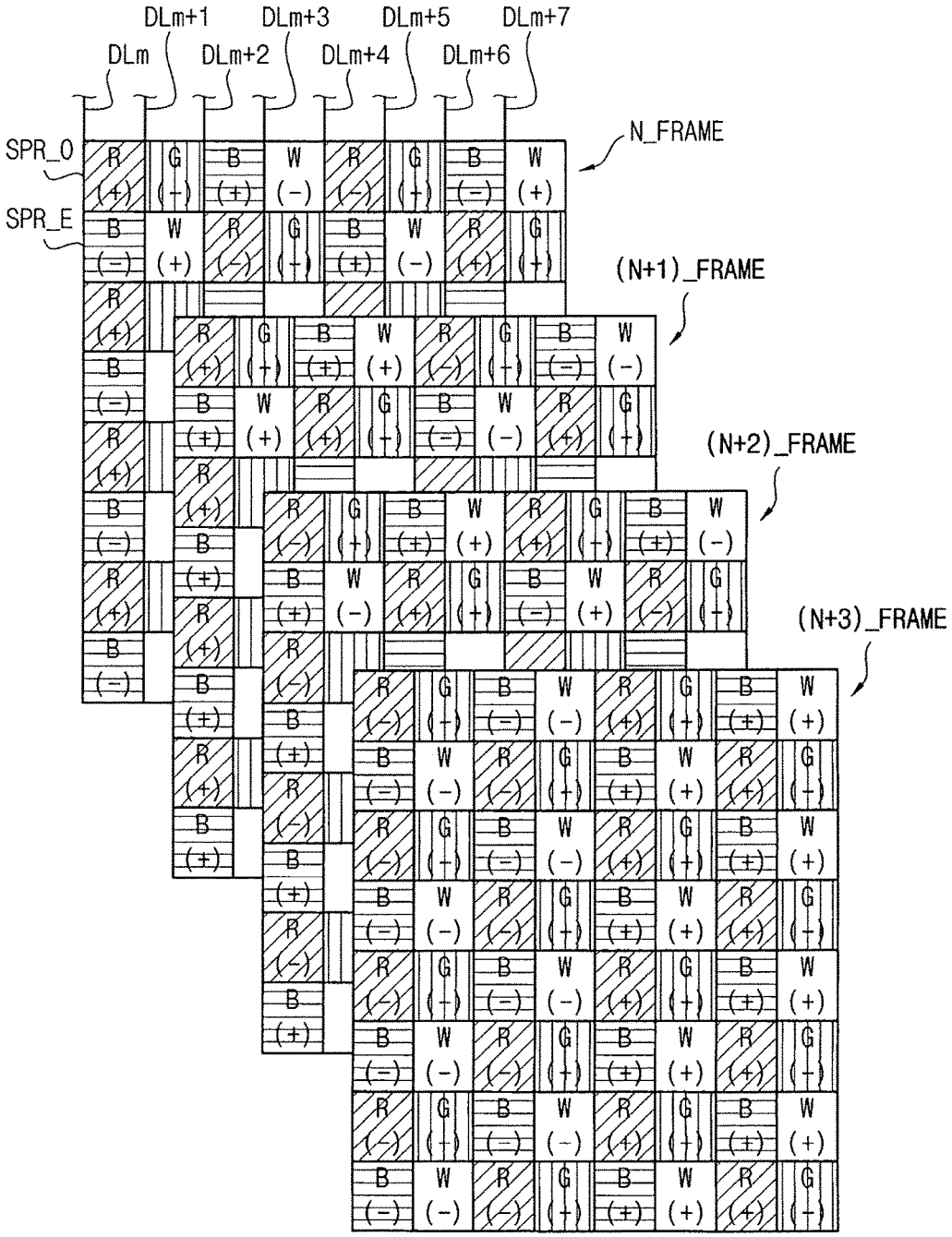

FIGS. 7A and 7B illustrate an output polarity pattern and an output polarity period according to an exemplary embodiment.

FIG. 7A illustrates the output polarity pattern and the output polarity period corresponding to the output polarity control signal. The output polarity pattern and output polarity period may be various preset, and may be stored in a register of the timing controller. The timing controller is configured to provide the data driver with the output polarity control signal corresponding to the output polarity pattern and the output polarity period.

According to the exemplary embodiment, the output polarity pattern includes a first inversion pattern (+−+−−+−+) and a second inversion pattern (++++−−−−). The display panel drives with the first inversion pattern (+−+−−+−+) during an N-th frame, drives with the second inversion pattern (++++−−−−) during an (N+1)-th frame, drives with an inversion pattern (−+−++−+−) opposite to the first inversion pattern (+−+−−+−+) during an (N+2)-th frame and drives with an inversion pattern (−−−−++++) opposite to the second inversion pattern (++++−−−−) during an (N+3)-th frame.

Referring to the alternateness structure in shown FIG. 7B, during the N-th frame N_FRAME, an odd-numbered color pixel row SPR_O of the display panel repeats polarities of (+−+−−+−+) and an even-numbered color pixel row SPR_E of the display panel repeats polarities of (−+−−+−++) which are shifted by one sub-pixel from the polarities (+−+−−+−+) of odd-numbered color pixel row SPR_O. During the (N+1)-th frame N+1_FRAME, the odd-numbered color pixel row SPR_O of the display panel repeats polarities of (++++−−−−) and the even-numbered color pixel row SPR_E of the display panel repeats polarities of (−−−++++−) which are shifted by one sub-pixel from the polarities (++++−−−−) of the odd-numbered color pixel row SPR_O.

During the (N+2)-th frame N+2_FRAME, an odd-numbered color pixel row SPR_O of the display panel repeats polarities of (−+−++−+−) and an even-numbered color pixel row SPR_E of the display panel repeats polarities of (+−++−+−−) which are shifted by one sub-pixel from the polarities (−+−++−+−) of the odd-numbered color pixel row SPR_O. During the (N+3)-th frame N+3_FRAME, the odd-numbered color pixel row SPR_O of the display panel repeats polarities of (−−−−++++) and the even-numbered color pixel row SPR_E of the display panel repeats polarities of (−−−++++−) which are shifted by one sub-pixel from the polarities (−−−−++++) of the odd-numbered color pixel row SPR_O.

Figure 8:
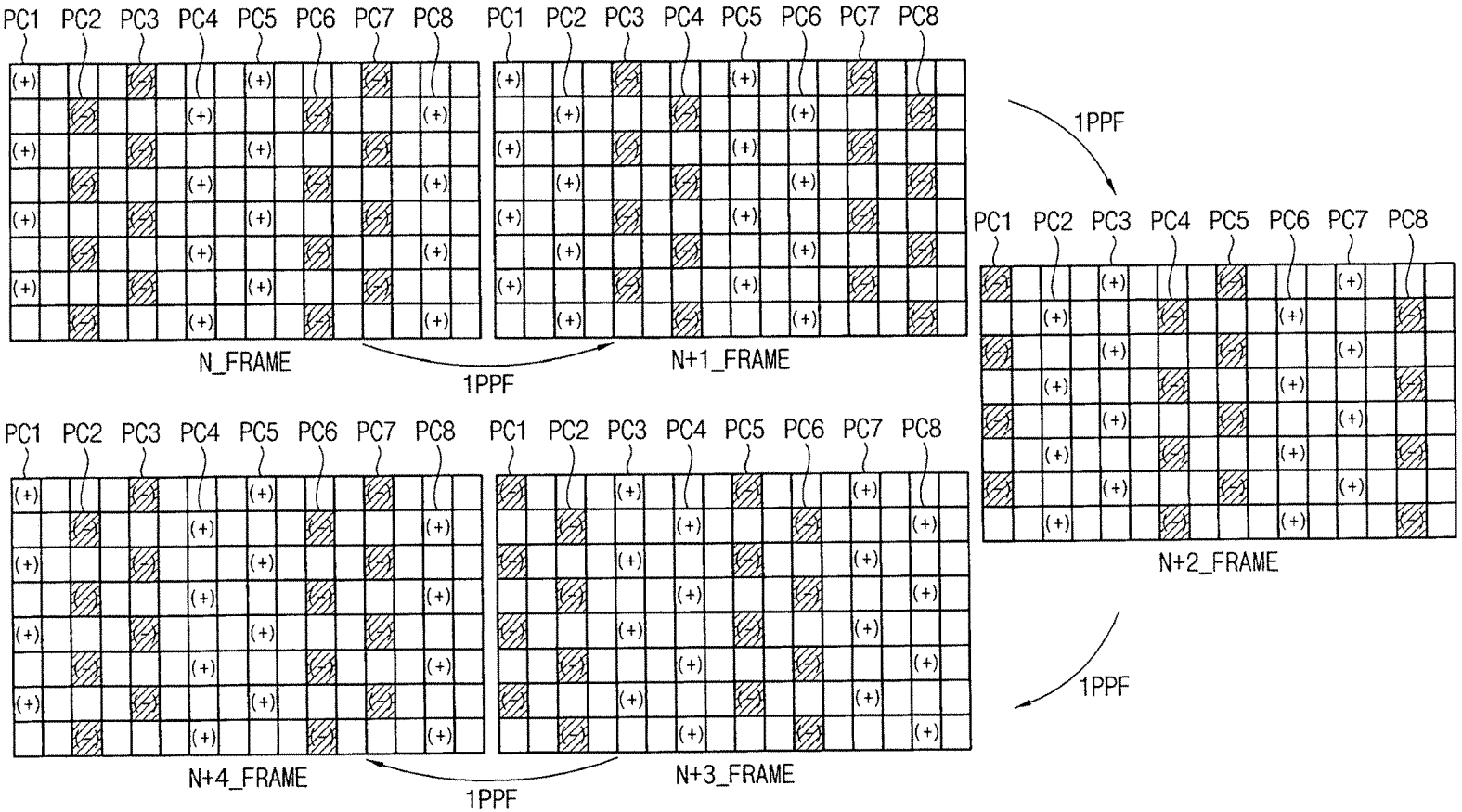
FIG. 8 is a hybrid diagram illustrating a polarity stuck period of a red sub-pixel according to the output polarity pattern and the output polarity period of FIGS. 7A and 7B.

FIG. 8 illustrates a polarity stuck period of a red sub-pixel according to the output polarity pattern and the output polarity period of FIGS. 7A and 7B.

Referring to FIG. 8, during the N-th frame N_FRAME, a red sub-pixel R in a first pixel column PC1 has a positive polarity (+), a red sub-pixel R of a second pixel column PC2 has a negative polarity (−), a red sub-pixel R of a third pixel column PC3 has the negative polarity (−), a red sub-pixel R of a fourth pixel column PC4 has the positive polarity (+), a red sub-pixel R of a fifth pixel column PC5 has the positive polarity (+), a red sub-pixel R of a sixth pixel column PC6 has the negative polarity (−), a red sub-pixel R of a seventh pixel column PC7 has the negative polarity (−) and a red sub-pixel R of an eighth pixel column PC8 has the positive polarity (+).

Then, during the (N+1)-th frame N+1_FRAME, polarities of the second to eighth pixel columns are equal to the polarities of the first to sixth pixel columns in the N-th frame N_FRAME. For example, the red sub-pixel R of the first pixel column PC1 in the N-th frame N_FRAME has the negative polarity (−) being equal to the red sub-pixel R of the second pixel column PC2 in the (N+1)-th frame N+1_FRAME, the red sub-pixel R of the second pixel column PC2 in the N-th frame N_FRAME has the negative polarity (−) being equal to the red sub-pixel R of the third pixel column PC3 in the (N+1)-th frame N+1_FRAME, the red sub-pixel R of the third pixel column PC3 in the N-th frame N_FRAME has the negative polarity (−) being equal to the red sub-pixel R of the fourth pixel column PC4 in the (N+1)-th frame N+1_FRAME, the red sub-pixel R of the fourth pixel column PC4 in the N-th frame N_FRAME has the positive polarity (+) being equal to the red sub-pixel R of the fifth pixel column PC5 in the (N+1)-th frame N+1_FRAME, the red sub-pixel R of the fifth pixel column PC5 in the N-th frame N_FRAME has the positive polarity (+) being equal to the red sub-pixel R of the sixth pixel column PC6 in the (N+1)-th frame N+1_FRAME, the red sub-pixel R of the sixth pixel column PC6 in the N-th frame N_FRAME has the negative polarity (−) being equal to the red sub-pixel R of the seventh pixel column PC7 in the (N+1)-th frame N+1_FRAME, and the red sub-pixel R of the seventh pixel column PC7 in the N-th frame N_FRAME has the negative polarity (−) being equal to the red sub-pixel R of the eighth pixel column PC8 in the (N+1)-th frame N+1_FRAME. Thus, the polarity stuck period between the red sub-pixels of the N-th and (N+1)-th frames N_FRAME and N+1_FRAME is a 1 PPF.

As described above, second to eighth pixel columns in an (N+2)-th frame N+2_FRAME have polarities being equal to first to seventh pixel columns in the (N+1)-th frame N+1_FRAME. Second to eighth pixel columns in an (N+3)-th frame N+3_FRAME have polarities being equal to first to seventh pixel columns in the (N+2)-th frame N+2_FRAME. Second to eighth pixel columns in an (N+4)-th frame N+4_FRAME have polarities being equal to first to seventh pixel columns in the (N+3)-th frame N+3_FRAME.

Thus, the polarity stuck period of the red sub-pixel R has a regular period per frame such as 1 PPF/1 PPF/1 PPF/1 PPF.

When the polarity stuck period is decreased, the moving line defects may be decreased. Therefore, the polarity stuck period of the red sub-pixel is equal to or less than 1 PPF and thus, the moving line defects may be substantially minimized or avoided.

Figure 9:
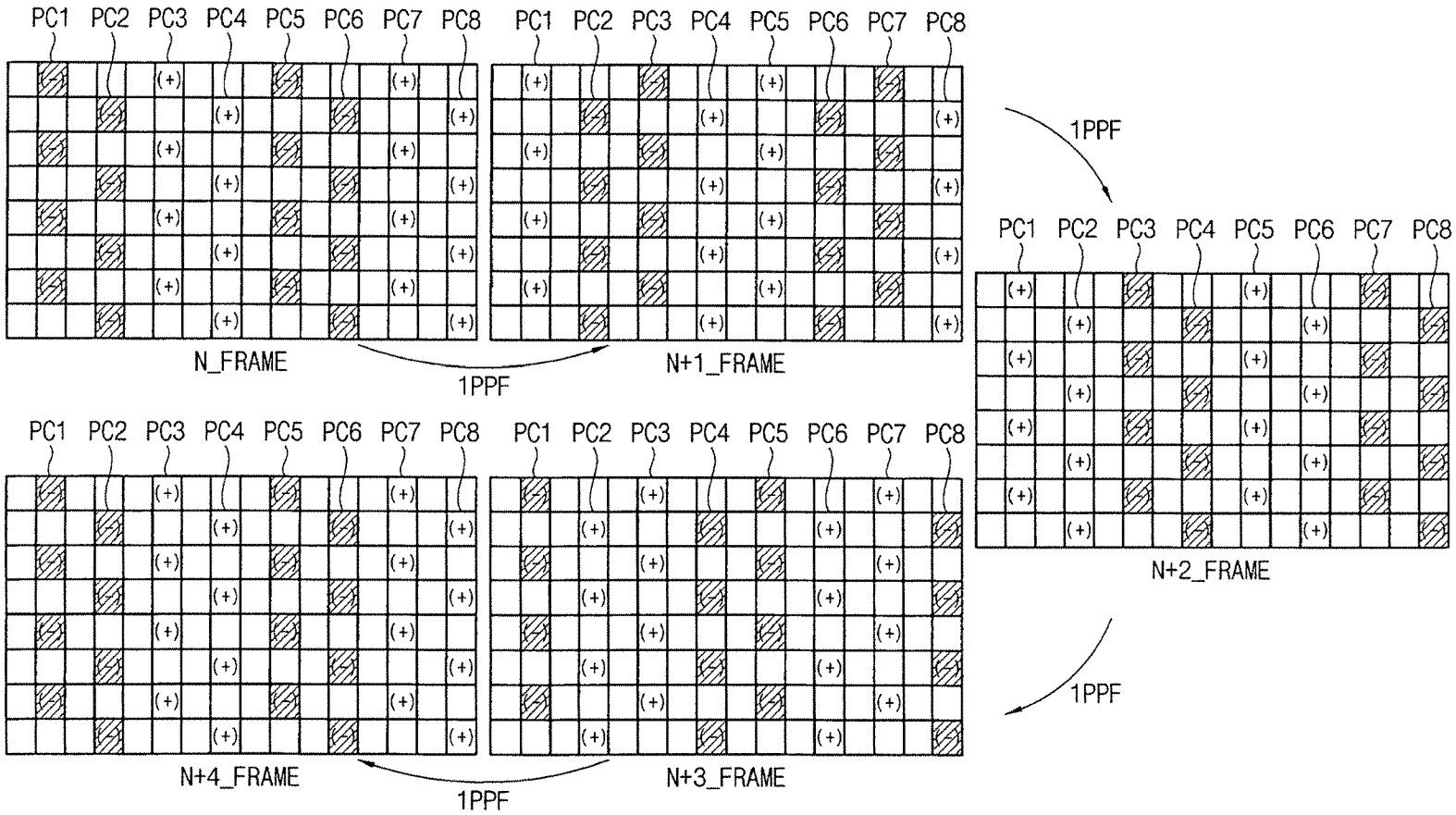
FIG. 9 is a hybrid diagram illustrating a polarity stuck period of a green sub-pixel according to the output polarity pattern and the output polarity period of FIGS. 7A and 7B.

FIG. 9 illustrates a polarity stuck period of a green sub-pixel according to the output polarity pattern and the output polarity period of FIGS. 7A and 7B.

Referring to FIG. 9, during the N-th frame N_FRAME, a green sub-pixel G in a first pixel column PC1 has a negative polarity (−), a green sub-pixel G of a second pixel column PC2 has the negative polarity (−), a green sub-pixel G of a third pixel column PC3 has a positive polarity (+), a green sub-pixel G of a fourth pixel column PC4 has the positive polarity (+), a green sub-pixel G of a fifth pixel column PC5 has the negative polarity (−), a green sub-pixel G of a sixth pixel column PC6 has the negative polarity (−), a green sub-pixel G of a seventh pixel column PC7 has the positive polarity (+) and a green sub-pixel G of an eighth pixel column PC8 has the positive polarity (+).

Then, during the (N+1)-th frame N+1_FRAME, polarities of the second to eighth pixel columns are equal to the polarities of the first to seventh pixel columns in the N-th frame N_FRAME. For example, the green sub-pixel G of the first pixel column PC1 in the N-th frame N_FRAME has the negative polarity (−) being equal to the green sub-pixel G of the second pixel column PC3 in the (N+1)-th frame N+1_FRAME, the green sub-pixel G of the second pixel column PC2 in the N-th frame N_FRAME has the negative polarity (−) being equal to the green sub-pixel G of the third pixel column PC3 in the (N+1)-th frame N+1_FRAME, the green sub-pixel G of the third pixel column PC3 in the N-th frame N_FRAME has the positive polarity (+) being equal to the green sub-pixel G of the fourth pixel column PC4 in the (N+1)-th frame N+1_FRAME, the green sub-pixel G of the fourth pixel column PC4 in the N-th frame N_FRAME has the positive polarity (+) being equal to the green sub-pixel G of the fifth pixel column PC5 in the (N+1)-th frame N+1_FRAME, the green sub-pixel G of the fifth pixel column PC5 in the N-th frame N_FRAME has the negative (−) being equal to the green sub-pixel G of the sixth pixel column PC6 in the (N+1)-th frame N+1_FRAME, the green sub-pixel G of the sixth pixel column PC6 in the N-th frame N_FRAME has the negative polarity (−) being equal to the green sub-pixel G of the seventh pixel column PC7 in the (N+1)-th frame N+1_FRAME, and the green sub-pixel G of the seventh pixel column PC7 in the N-th frame N_FRAME has the positive polarity (+) being equal to the green sub-pixel G of the eighth pixel column PC8 in the (N+1)-th frame N+1_FRAME. Thus, the polarity stuck period between the green sub-pixels of the N-th and (N+1)-th frames N_FRAME and N+1_FRAME is a 1 PPF.

As described above, second to eighth pixel columns in an (N+2)-th frame N+2_FRAME have polarities being equal to first to seventh pixel columns in the (N+1)-th frame N+1_FRAME. Second to eighth pixel columns in an (N+3)-th frame N+3_FRAME have polarities being equal to first to seventh pixel columns in the (N+2)-th frame N+2_FRAME. Second to eighth pixel columns in an (N+4)-th frame N+4_FRAME have polarities being equal to first to seventh pixel columns in the (N+3)-th frame N+3_FRAME.

Thus, the polarity stuck period of the red sub-pixel R has a regular period per frame such as 1 PPF/1 PPF/1 PPF/1 PPF.

When the polarity stuck period is decreased, the moving line defects may be decreased. Therefore, the polarity stuck period of the green sub-pixel is less than 1 PPF and thus, the moving line defects may be substantially minimized or avoided.

Figure 10:
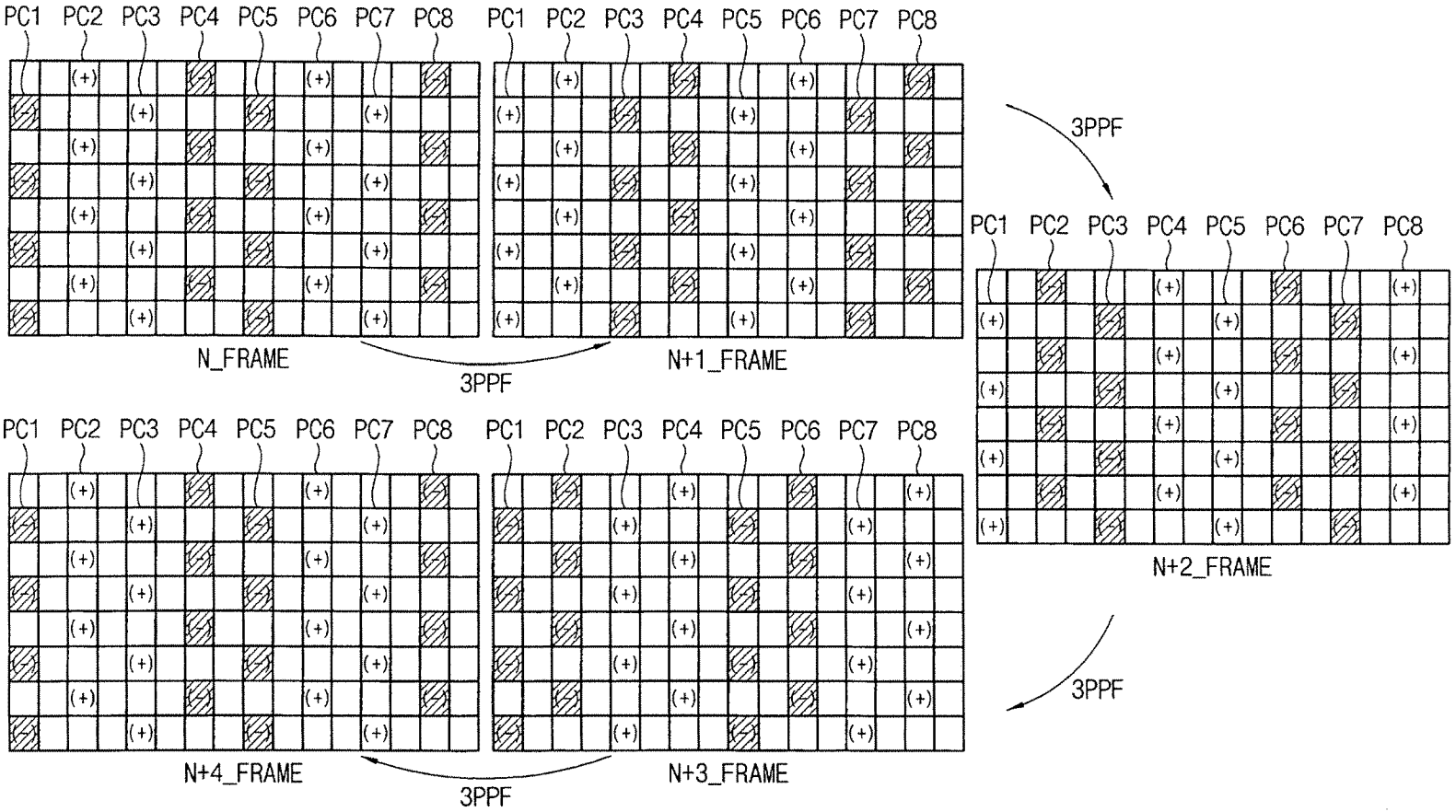
FIG. 10 is a hybrid diagram illustrating a polarity stuck period of a blue sub-pixel according to the output polarity pattern and the output polarity period of FIGS.

FIG. 10 illustrates a polarity stuck period of a blue sub-pixel according to the output polarity pattern and the output polarity period of FIGS. FIGS. 7A and 7B.

Referring to FIG. 10, during the N-th frame N_FRAME, a blue sub-pixel B in a first pixel column PC1 has a negative polarity (−), a blue sub-pixel B of a second pixel column PC2 has a positive polarity (+), a blue sub-pixel B of a third pixel column PC3 has the positive polarity (+), a blue sub-pixel B of a fourth pixel column PC4 has the negative polarity (−), a blue sub-pixel B of a fifth pixel column PC5 has the negative polarity (−), a blue sub-pixel B of a sixth pixel column PC6 has the positive polarity (+), a blue sub-pixel B of a seventh pixel column PC7 has the positive polarity (+) and a blue sub-pixel B of an eighth pixel column PC8 has the negative polarity (−).

Then, during the (N+1)-th frame N+1_FRAME, polarities of the fourth to eighth pixel columns are equal to the polarities of the first to fifth pixel columns in the N-th frame N_FRAME. For example, the blue sub-pixel B of the first pixel column PC1 in the N-th frame N_FRAME has the negative polarity (−) being equal to the blue sub-pixel B of the fourth pixel column PC4 in the (N+1)-th frame N+1_FRAME, the blue sub-pixel B of the second pixel column PC2 in the N-th frame N_FRAME has the positive polarity (+) being equal to the blue sub-pixel B of the fifth pixel column PC5 in the (N+1)-th frame N+1_FRAME, the blue sub-pixel B of the third pixel column PC3 in the N-th frame N_FRAME has the positive polarity (+) being equal to the blue sub-pixel B of the sixth pixel column PC6 in the (N+1)-th frame N+1_FRAME, the blue sub-pixel B of the fourth pixel column PC4 in the N-th frame N_FRAME has the negative polarity (−) being equal to the blue sub-pixel B of the seventh pixel column PC7 in the (N+1)-th frame N+1_FRAME, and the blue sub-pixel B of the fifth pixel column PC5 in the N-th frame N_FRAME has the negative polarity (−) being equal to the blue sub-pixel B of the eighth pixel column PC8 in the (N+1)-th frame N+1_FRAME. Thus, the polarity stuck period between the blue sub-pixels of the N-th and (N+1)-th frames N_FRAME and N+1_FRAME is a 3 PPF.

As described above, fourth to eighth pixel columns in an (N+2)-th frame N+2_FRAME have polarities being equal to first to fifth pixel columns in the (N+1)-th frame N+1_FRAME. Fourth to eighth pixel columns in an (N+3)-th frame N+3_FRAME have polarities being equal to first to fifth pixel columns in the (N+2)-th frame N+2_FRAME. Fourth to eighth pixel columns in an (N+4)-th frame N+4_FRAME have polarities being equal to first to fifth pixel columns in the (N+3)-th frame N+3_FRAME.

As described above, the polarity stuck period of the red sub-pixel R has a regular period per frame such as 3 PPF/3 PPF/3 PPF/3 PPF, however blue color is lowest with respect to contribution of luminance. Thus, the moving line defects is substantially minimized or avoided.

Figure 11:
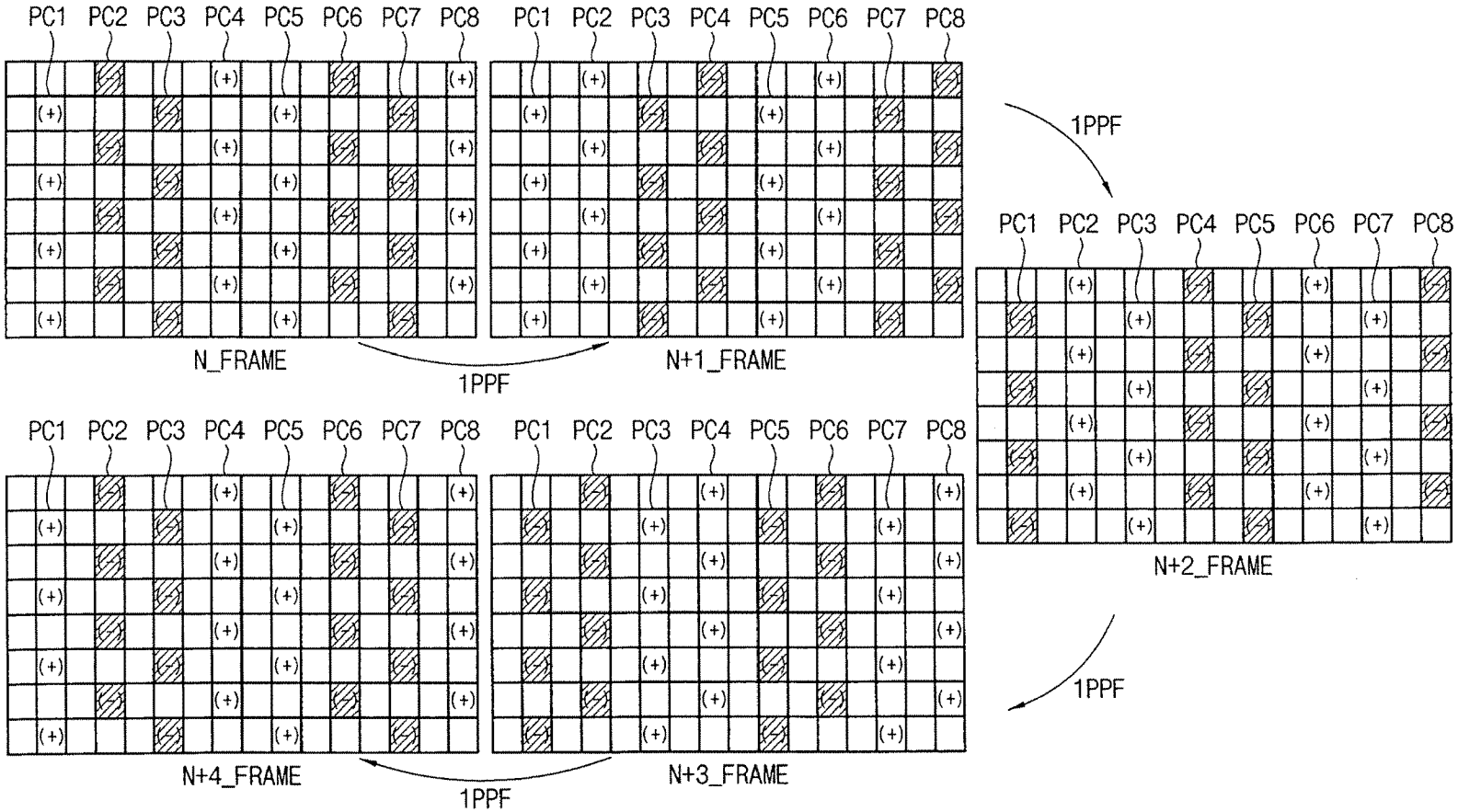
FIG. 11 is a hybrid diagram illustrating a polarity stuck period of a white sub-pixel according to the output polarity pattern and the output polarity period of FIGS. 7A and 7B.

FIG. 11 illustrates a polarity stuck period of a white sub-pixel according to the output polarity pattern and the output polarity period of FIGS. 7A and 7B.

Referring to FIG. 11, during the N-th frame N_FRAME, a white sub-pixel W in a first pixel column PC1 has a positive polarity (+), a white sub-pixel W of a second pixel column PC2 has a negative polarity (−), a white sub-pixel W of a third pixel column PC3 has the negative polarity (−), a white sub-pixel W of a fourth pixel column PC4 has the positive polarity (+), a white sub-pixel W of a fifth pixel column PC5 has the positive polarity (+), a white sub-pixel W of a sixth pixel column PC6 has the negative polarity (−), a white sub-pixel W of a seventh pixel column PC7 has the negative polarity (−) and a white sub-pixel W of an eighth pixel column PC8 has the positive polarity (+).

Then, during the (N+1)-th frame N+1_FRAME, polarities of the second to eighth pixel columns are equal to the polarities of the first to seventh pixel columns in the N-th frame N_FRAME. For example, the white sub-pixel W of the first pixel column PC1 in the N-th frame N_FRAME has the positive polarity (+) being equal to the white sub-pixel W of the second pixel column PC2 in the (N+1)-th frame N+1_FRAME, the white sub-pixel W of the second pixel column PC2 in the N-th frame N_FRAME has the negative polarity (−) being equal to the white sub-pixel W of the third pixel column PC3 in the (N+1)-th frame N+1_FRAME, the white sub-pixel W of the third pixel column PC3 in the N-th frame N_FRAME has the negative polarity (−) being equal to the white sub-pixel W of the fourth pixel column PC4 in the (N+1)-th frame N+1_FRAME, the white sub-pixel W of the fourth pixel column PC4 in the N-th frame N_FRAME has the positive polarity (+) being equal to the white sub-pixel W of the fifth pixel column PC5 in the (N+1)-th frame N+1_FRAME, the white sub-pixel W of the fifth pixel column PC5 in the N-th frame N_FRAME has the positive polarity (+) being equal to the white sub-pixel W of the sixth pixel column PC6 in the (N+1)-th frame N+1_FRAME, the white sub-pixel W of the sixth pixel column PC6 in the N-th frame N_FRAME has the negative polarity (−) being equal to the white sub-pixel W of the seventh pixel column PC7 in the (N+1)-th frame N+1_FRAME, and the white sub-pixel W of the seventh pixel column PC7 in the N-th frame N_FRAME has the negative polarity (−) being equal to the white sub-pixel W of the eighth pixel column PC8 in the (N+1)-th frame N+1_FRAME. Thus, the polarity stuck period between the white sub-pixels of the N-th and (N+1)-th frames N_FRAME and N+1_FRAME is a 1 PPF.

As described above, second to eighth pixel columns in an (N+2)-th frame N+2_FRAME have polarities being equal to first to seventh pixel columns in the (N+1)-th frame N+1_FRAME. Second to eighth pixel columns in an (N+3)-th frame N+3_FRAME have polarities being equal to first to seventh pixel columns in the (N+2)-th frame N+2_FRAME. Second to eighth pixel columns in an (N+4)-th frame N+4_FRAME have polarities being equal to first to seventh pixel columns in the (N+3)-th frame N+3_FRAME.

Thus, the polarity stuck period of the white sub-pixel W has a regular period per frame such as 1 PPF/1 PPF/1 PPF/1 PPF.

When the polarity stuck period is decreased, the moving line defects may be decreased. Therefore, the polarity stuck period of the white sub-pixel is equal to or less than 1 PPF and thus, the moving line defects may be substantially minimized or avoided.

According to the exemplary embodiment referring to FIGS. 7A to 11, the polarity stuck period of at least one of the plurality of color sub-pixels is different from the polarity stuck period of the other of the plurality of color sub-pixels and thus, the moving line defects may be substantially minimized or avoided. In addition, the polarity stuck period of at least one of the plurality of color sub-pixels is less than 1 PPF (e.g., 3 PPF) and thus, the moving line defects may be substantially minimized or avoided. For example, a polarity stuck period of a first color sub-pixel of the plurality of color sub-pixels between first and second successive frames is different from at a polarity stuck period of a second color sub-pixel between the first and second frames.

As in the exemplary embodiments, a different one of a plurality of spatial sub-pixel polarity patterns is output to a plurality of sub-pixels for each of a plurality of successive frames. The number of positive and negative polarity data voltages output to each sub-pixel is substantially fixed over the plurality of successive frames, and will be equal unless other design considerations call for a different ratio.

Although the exemplary embodiments have provided each of the plurality of sub-pixel polarity patterns being the opposite of another of the plurality of sub-pixel patterns for ease of explanation, it shall be understood that the present inventive concept is not limited thereto. For example, four successive patterns could be (+−+−−+−+), (−+−+−−++), (++−−++−−), (−−+++−+−) and thereby meet the equalization requirement without using strictly opposite patterns. As will be recognized by those of ordinary skill in the pertinent art, numerous alternate patterns may be substituted for the exemplary patterns set forth herein.

According to exemplary embodiments, the polarity stuck period of at least one of the plurality of color sub-pixels is different from the polarity stuck period of the other of the plurality of color sub-pixels and thus, the polarity stuck periods of the color sub-pixels are different from the moving speed of the moving image. Therefore, the moving line defects may be substantially minimized or avoided.

The foregoing is illustrative of the inventive concept and is not to be construed as limiting thereof. Although exemplary embodiments of the inventive concept have been described, those of ordinary skill in the pertinent art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a display panel comprising a plurality of data lines, a plurality of gate lines crossing the plurality of data lines and a plurality of pixels connected to the plurality of data lines and the plurality of gate lines, each of the plurality of pixels comprising a plurality of color sub-pixels; and a data driver providing to the plurality of data lines data voltages of a positive polarity and a negative polarity opposite to the positive polarity with respect to a reference voltage, wherein a polarity stuck period of at least one color sub-pixel of the plurality of color sub-pixels is different from a polarity stuck period of another color sub-pixel of the plurality of color sub-pixels, and the polarity stuck period is a pixel distance in which a same polarity moves per frame.

2. The display apparatus of claim 1, wherein a polarity stuck period of at least one color sub-pixel of the plurality of color sub-pixels is irregularly changed per frame.

3. The display apparatus of claim 2, wherein a polarity stuck period of at least one color sub-pixel of the plurality of color sub-pixels is irregularly changed per frame, wherein the irregularly changed period is periodically repeated over multiple frames.

4. The display apparatus of claim 1, wherein a polarity stuck period of at least one color sub-pixel of the plurality of color sub-pixels is not equal to 1 Pixel Per Frame (PPF).

5. The display apparatus of claim 1, wherein the display panel comprises a plurality of pixel rows and a plurality of pixel column, and color sub-pixels in a pixel column are alternately connected to two adjacent data lines.

6. The display apparatus of claim 4, wherein the plurality of color sub-pixels comprises a red sub-pixel, a green sub-pixel, a blue sub-pixel and a white sub-pixel.

7. The display apparatus of claim 6, wherein the data driver is configured to output data voltages of polarities corresponding to a first inversion pattern to the plurality of data lines in an N-th frame, to output data voltages of polarities opposite to the first inversion pattern to the plurality of data lines in an (N+1)-th frame, to output data voltages of polarities corresponding to a second inversion pattern different from the first and first opposite inversion patterns to the plurality of data lines in an (N+2)-th frame, and to output data voltages of polarities opposite to the second inversion pattern to the plurality of data lines in an (N+3)-th frame.

8. The display apparatus of claim 6, wherein the data driver is configured to output data voltages of polarities corresponding to a first inversion pattern to the plurality of data lines in an N-th frame, to output data voltages of polarities corresponding to a second inversion pattern different but not opposite to the first inversion pattern to the plurality of data lines in an (N+1)-th frame, to output data voltages of polarities opposite to the first inversion pattern to the plurality of data lines in an (N+2)-th frame, and to output data voltages of polarities opposite to the second inversion pattern to the plurality of data lines in an (N+3)-th frame.

9. A method of driving a display apparatus, which comprises a display panel comprising a plurality of data lines, a plurality of gate lines crossing the plurality of data lines and a plurality of pixels connected to the plurality of data lines and the plurality of gate lines, each of the plurality of pixels comprising a plurality of color sub-pixels, the method comprising:

outputting data voltages of a positive polarity and a negative polarity opposite to the positive polarity with respect to a reference voltage to the plurality of data lines, wherein a polarity stuck period of at least one color sub-pixel of the plurality of color sub-pixels is different from a polarity stuck period of another color sub-pixel of the plurality of color sub-pixels, and the polarity stuck period is a pixel distance in which a same polarity moves per frame.

10. The method of claim 9, wherein a polarity stuck period of at least one color sub-pixel of the plurality of color sub-pixels is irregularly changed by a frame.

11. The method of claim 10, wherein a polarity stuck period of at least one color sub-pixel of the plurality of color sub-pixels is irregularly changed by a frame, wherein the irregularly changed period is periodically repeated.

12. The method of claim 9, wherein a polarity stuck period of at least one color sub-pixel of the plurality of color sub-pixels is not equal to 1 Pixel Per Frame (PPF).

13. The method of claim 9, wherein the display panel comprises a plurality of pixel rows and a plurality of pixel column, color sub-pixels in a pixel column are alternately connected to adjacent two data lines.

14. The method of claim 13, wherein the plurality of color sub-pixels comprises a red sub-pixel, a green sub-pixel, a blue sub-pixel and a white sub-pixel.

15. The method of claim 14, wherein the data driver is configured to output data voltages of polarities corresponding to a first inversion pattern to the plurality of data lines in an N-th frame, to output data voltages of polarities opposite to the first inversion pattern to the plurality of data lines in an (N+1)-th frame, to output data voltages of polarities corresponding to a second inversion pattern different from the first and first opposite inversion patterns to the plurality of data lines in an (N+2)-th frame, and to output data voltages of polarities opposite to the second inversion pattern to the plurality of data lines in an (N+3)-th frame.

16. The method of claim 15, wherein the data driver is configured to output data voltages of polarities corresponding to a first inversion pattern to the plurality of data lines in an N-th frame, to output data voltages of polarities corresponding to a second inversion pattern different but not opposite to the first inversion pattern to the plurality of data lines in an (N+1)-th frame, to output data voltages of polarities opposite to the first inversion pattern to the plurality of data lines in an (N+2)-th frame, and to output data voltages of polarities opposite to the second inversion pattern to the plurality of data lines in an (N+3)-th frame.

17. A method of driving a display apparatus having a display panel with a plurality of color sub-pixels, the method comprising:

for each of a plurality of successive frames, outputting to the plurality of color sub-pixels data voltages of a positive polarity and a negative polarity using variable polarity stuck periods being a pixel distance in which a same polarity moves between a pair of successive frames, wherein a polarity stuck period of a first color sub-pixel of the plurality of color sub-pixels between first and second successive frames is different from at least one of a polarity stuck period of a second color sub-pixel between the first and second frames or different from a polarity stuck period of the first color sub-pixel between the second frame and a third successive frame.

18. The method of claim 17 wherein a different one of a plurality of spatial sub-pixel polarity patterns is output to a plurality of sub-pixels for each of the plurality of successive frames.

19. The method of claim 18 wherein the number of positive and negative polarity data voltages output to each sub-pixel is substantially equal over the plurality of successive frames.

20. The method of claim 19 wherein each of the plurality of sub-pixel polarity patterns is the opposite of another of the plurality of sub-pixel patterns.

* * * * *